US008807147B2

(12) United States Patent
Kim et al.

(10) Patent No.: US 8,807,147 B2
(45) Date of Patent: Aug. 19, 2014

(54) COSMETIC POWDER CONTAINER

(76) Inventors: Jin-Woo Kim, Gwangmyeong-si (KR); Kyu-sun Jung, Anyang-si (KR)

( * ) Notice: Subject to any disclaimer, the term of this patent is extended or adjusted under 35 U.S.C. 154(b) by 0 days.

(21) Appl. No.: 13/202,054

(22) PCT Filed: Jun. 7, 2011

(86) PCT No.: PCT/KR2011/004157

§ 371 (c)(1),
(2), (4) Date: Mar. 16, 2012

(87) PCT Pub. No.: WO2012/015162

PCT Pub. Date: Feb. 2, 2012

(65) Prior Publication Data

US 2013/0319454 A1 Dec. 5, 2013

(30) Foreign Application Priority Data

Feb. 25, 2011 (KR) ..... 10-2011-0017262

(51) Int. Cl.

| | |
|---|---|
| ***A45D 33/02*** | (2006.01) |
| ***A45D 33/00*** | (2006.01) |
| ***B65D 69/00*** | (2006.01) |
| ***B65D 71/00*** | (2006.01) |
| ***B67D 7/76*** | (2010.01) |
| ***A45D 33/06*** | (2006.01) |

(52) U.S. Cl.

CPC ..... *A45D 33/02* (2013.01); *A45D 33/025* (2013.01); *A45D 33/06* (2013.01); *A45D 33/006* (2013.01); *Y10S 206/823* (2013.01)

USPC ..... 132/298; 132/293; 132/307; 206/581; 206/823; 206/235; 222/189.02

(58) Field of Classification Search

CPC ... A45D 33/003; A45D 33/025; A45D 33/02; A45D 33/06; A45D 33/006; A45D 40/00; B65D 83/06

USPC ..... 132/298, 286, 290, 293–295, 299, 300, 132/303, 305–307; 222/189.05, 480, 142.9, 222/548, 565, 189.02, 189.03; 209/371, 209/397; 220/370, 371, 372; 206/235, 581, 206/823; 215/296, 300, 299, 308

See application file for complete search history.

(56) References Cited

U.S. PATENT DOCUMENTS

| | | | | |
|---|---|---|---|---|
| 3,265,255 | A * | 8/1966 | Mitchell | 222/425 |
| 3,937,347 | A * | 2/1976 | Cottingham | 215/213 |
| 4,586,519 | A * | 5/1986 | Seidler et al. | 132/293 |
| 4,674,520 | A * | 6/1987 | Gretshel et al. | 132/286 |
| 5,295,496 | A * | 3/1994 | Machelett | 132/293 |

(Continued)

*Primary Examiner* — Vanitha Elgart
(74) *Attorney, Agent, or Firm* — John K. Park; Park Law Firm

(57) ABSTRACT

A cosmetic powder container, including: a container body for containing cosmetic powder therein; a middle cap defining a powder application space, with a powder discharging part provided in the bottom of the middle cap; an outer cap removably fastened to the container body, with an annular sealing protrusion formed in the outer cap so as to be brought into close contact with the middle cap; a sealing cap assembled with a locking collar formed on the lower surface of the outer cap, with an annular sealing foot formed on the lower surface of the sealing cap so as to be closely seated on an outer shoulder of the powder discharging part when the outer cap is closed to the container body, and with a sealing bottom formed inside the annular sealing foot and fitted into the sealing step; and a powder charge cap.

11 Claims, 18 Drawing Sheets

(56) References Cited

U.S. PATENT DOCUMENTS

| | | | | |
|---|---|---|---|---|
| 5,320,116 | A * | 6/1994 | Ackermann | 132/293 |
| 5,515,875 | A * | 5/1996 | Acker et al. | 132/298 |
| 5,598,929 | A * | 2/1997 | Jensen et al. | 206/527 |
| 5,682,910 | A * | 11/1997 | Kizawa et al. | 132/293 |
| 5,896,866 | A * | 4/1999 | Quennessen | 132/293 |
| 6,053,183 | A * | 4/2000 | Rizzo | 132/307 |
| 6,336,460 | B2 * | 1/2002 | Yuhara | 132/295 |
| 6,354,308 | B1 * | 3/2002 | Kuk | 132/301 |
| 6,945,403 | B2 * | 9/2005 | Lombardi | 206/581 |
| 7,028,843 | B2 * | 4/2006 | Byun | 206/581 |
| 7,476,048 | B2 * | 1/2009 | Prague | 401/262 |
| 8,210,187 | B1 * | 7/2012 | Zhang | 132/299 |
| 8,286,648 | B2 * | 10/2012 | Thorpe et al. | 132/307 |
| D690,881 | S * | 10/2013 | Lai | D28/82 |
| 2002/0056660 | A1 * | 5/2002 | Gueret | 206/525 |
| 2003/0024545 | A1 * | 2/2003 | Delage | 132/299 |
| 2003/0029471 | A1 * | 2/2003 | Jang | 132/293 |
| 2003/0141273 | A1 * | 7/2003 | Osti | 215/364 |
| 2003/0154997 | A1 * | 8/2003 | Lin | 132/307 |
| 2005/0109363 | A1 * | 5/2005 | Matsuoka | 132/298 |
| 2009/0205673 | A1 * | 8/2009 | Richardson | 132/307 |
| 2009/0272399 | A1 * | 11/2009 | Kim | 132/293 |
| 2010/0012145 | A1 * | 1/2010 | LoPrete | 132/307 |
| 2011/0048442 | A1 * | 3/2011 | Pires et al. | 132/200 |
| 2013/0087165 | A1 * | 4/2013 | Lee et al. | 132/286 |

* cited by examiner

COSMETIC POWDER CONTAINER

TECHNICAL FIELD

The present invention relates, in general, to a cosmetic powder container, which has a structure configured to separately receive therein a powder puff or a make-up brush (hereinbelow, referred to simply as 'make-up utensil') used for applying cosmetic powder that beautifies the skin of a user, and is configured to prevent the powder from undesirably leaking out of the powder container through a flexible mesh type or perforated type powder discharging part provided in a middle cap for discharging the powder when applying make-up, while the powder container is being carried or stored, thereby realizing a reliable sealing function of the powder container and preventing loss of the powder caused by the undesired leaking out of the powder, and preventing the outer surface of the powder container and the interior of a bag carrying the container from being soiled by the leaking powder.

BACKGROUND ART

Generally, cosmetic powder is a kind of beautifier used for applying make-up to the skin of a user, such as a user's face, or for removing moisture from the skin. Cosmetic powder is typically applied to the skin using a make-up utensil, such as a powder puff or a make-up brush. Further, the cosmetic powder has been typically carried and used in a state in which the powder is contained in a specified container that is referred to as a cosmetic powder container. Further, conventional cosmetic powder containers proposed and used in the related art have been typically configured to receive respective make-up utensils therein.

The construction of an example of conventional cosmetic powder containers is shown in FIG. 1 and FIG. 2. As shown in the drawings, the cosmetic powder container 1 includes a container body 2 which is open at an end thereof so as to contain cosmetic powder therein, an outer cap 3 tightened to the open end of the container body via a screw type of engagement, a middle cap 4 installed at a location between the container body and the outer cap and receiving therein a make-up utensil 6 (in FIG. 1 and FIG. 2, a powder puff as the make-up utensil is received), and a mesh 5 or perforations 5A (hereinbelow, referred to as 'powder discharging part') formed in the central area of the bottom of the middle cap so as to discharge the cosmetic powder from the container body.

To apply cosmetic powder to the skin of a user using the cosmetic powder container 1 having the above-mentioned construction, the user may move the powder container 1 in a state in which the outer cap 3 is tightened to the container body, so that the powder is discharged from the container body 2 through the powder discharging part 5 or 5A provided in the middle cap 4 and is applied to the make-up utensil 6, and thereafter, the user may apply the powder of the make-up utensil 6 to the skin. Alternatively, the user may perform the above-mentioned process after opening the outer cap 3 in the initial stage of a make-up process and applies make-up to the skin using powder, which has been applied to the make-up utensil 6.

When the make-up has been completely applied, the user receives the make-up utensil 6 in the middle cap 4 and tightens the outer cap 3 to the container body 2, and carries on oneself the powder container.

DISCLOSURE

Technical Problem

However, the structure of the conventional cosmetic powder container 1 is configured in such a way that a user can use the powder contained in the container body 2 for make-up by applying the powder to the make-up utensil 6 received in the middle cap 4, and that the powder discharging part 5 or 5A provided in the middle cap 4 for applying the powder to the make-up utensil 6 has a mesh structure or a perforated structure. Therefore, when the cosmetic powder container 1 is carried by a user, for example, when the powder container is carried by the user while not being used for make-up, the powder is naturally discharged to the make-up utensil 6 through the powder discharging part 5 or 5A provided in the middle cap 4 due to movement of the container body 2 or impact applied to the body 2.

Further, the conventional cosmetic powder container 1 is structurally problematic in that the container does not have additional means for preventing the powder from leaking out of the container body 2 through the powder discharging part 5 or 5A of the middle cap 4 when the container is not being used for make-up, although the container is intended to prevent powder from leaking out of the container body using the make-up utensil 6 received in the middle cap 4 or by tightening the outer cap 3 to the container body. However, the powder container has a structural problem in that it cannot block the mesh type or perforated type powder discharging part 5 while being carried by the user.

Therefore, the conventional cosmetic powder container 1 has a structural limit in that, when the container is being carried by a user, it may easily move around, so that the powder may be continuously and naturally discharged from the container body 2 through the powder discharging part 5 or 5A. Further, the powder primarily discharged from the container body into the middle cap 4 may naturally leak out of the cosmetic powder container 1 through a micro gap defined in a screw-type engaged junction between the outer circumferential surface of the open end of the container body 2 and the outer cap 3 tightened to the container body, thereby being dispersed into the atmosphere. The leaking out of the powder into the atmosphere causes a loss of the powder, reduces the expected time the powder container can be used for, and spoils and contaminates the powder container and substances around the container, for example, the interior of a bag storing therein the powder container and other articles kept in the bag along with the powder container. This causes serious problems in that consumers may rate the reliability of products low and may hesitate to purchase the products.

Technical Solution

Accordingly, the present invention has been made keeping in mind the above problems occurring in the related art, and is intended to provide a cosmetic powder container, which has a structure capable of separately receiving therein a make-up utensil and in which a powder discharging part provided in a middle cap can be reliably opened or closed by a sealing cap provided in an outer cap in response to an opening or closing motion of the outer cap, so that, even when the powder container is carried by a user while not being used, the powder discharging part of the middle cap can always stay reliably closed thanks to the sealing cap irrespective of movement of the powder container barring opening of the outer cap, thereby preventing a loss of powder caused by it leaking out of the powder container and preventing the powder container and substances around it, such as the interior of a bag wherein is stored the powder container and articles kept in the bag along with the powder container, from being spoiled or contaminated by the powder.

Advantageous Effects

The cosmetic powder container according to the first embodiment of the present invention is advantageous in that the sealing cap provided in the outer cap can reliably seal the powder discharging part provided in the middle cap, so that, even when the powder container is carried with a user, it is possible to prevent powder from leaking out through the powder discharging part, thereby preventing loss of powder caused by the leaking out thereof and preventing the substances of the powder container from being soiled by the leaked powder, and thereby allowing the cosmetic powder container to be used safely and hygienically.

The first embodiment of the present invention is further advantageous in that the sealing bottom of the sealing cap is provided with a vertical or inclined side surface, so that, even when there occurs a some sealing deviation in the annular sealing protrusion of the outer cap or in the annular sealing foot of the sealing cap according to work conditions or characteristics of materials when the sealing cap has been assembled with the outer cap, the desired sealing effect between the middle cap and the sealing step can be realized.

Further, the cosmetic powder container according to the second embodiment of the present invention is advantageous in that it uses an automatic sealing structure, in which, after a desired amount of powder has been completely charged in the container body through the powder charge opening formed in the bottom of the container body, the powder charge opening can be automatically closed by the powder charge cap, so that the second embodiment can realize the operational effects of the first embodiment and, further, realizes an automatic powder charging process of automatically charging powder in the container body, thereby simplifying the powder charging process and remarkably reducing the incidental cost affiliated with the production cost of the container, including the labor cost.

Further, the cosmetic powder container according to the third embodiment of the present invention is advantageous in that the powder discharging part provided in the middle cap can be automatically opened or closed in response to an opening or closing motion of the outer cap, thereby reliably preventing the powder from leaking out through the powder discharging part and realizing a simple locking structure of the sealing cap and improving the bottom structure of the container body, and thereby allowing a user to completely use the powder charged in the container body.

BEST MODE

Figure 1:
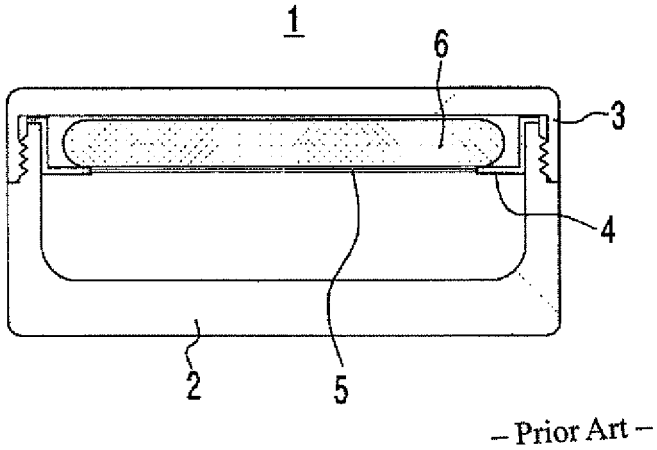
FIG. 1 and FIG. 2 are cross-sectional views illustrating the fully-assembled construction of conventional cosmetic powder containers.
Figure 2:
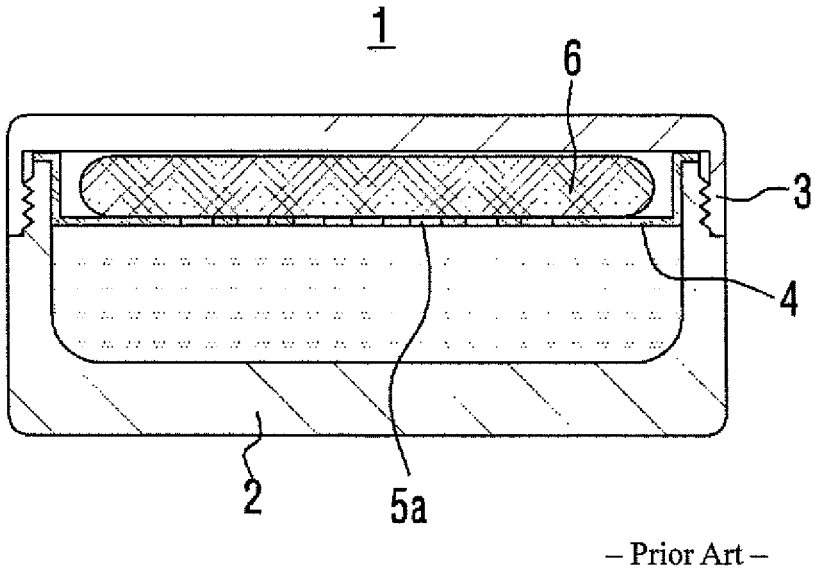
Figure 3:
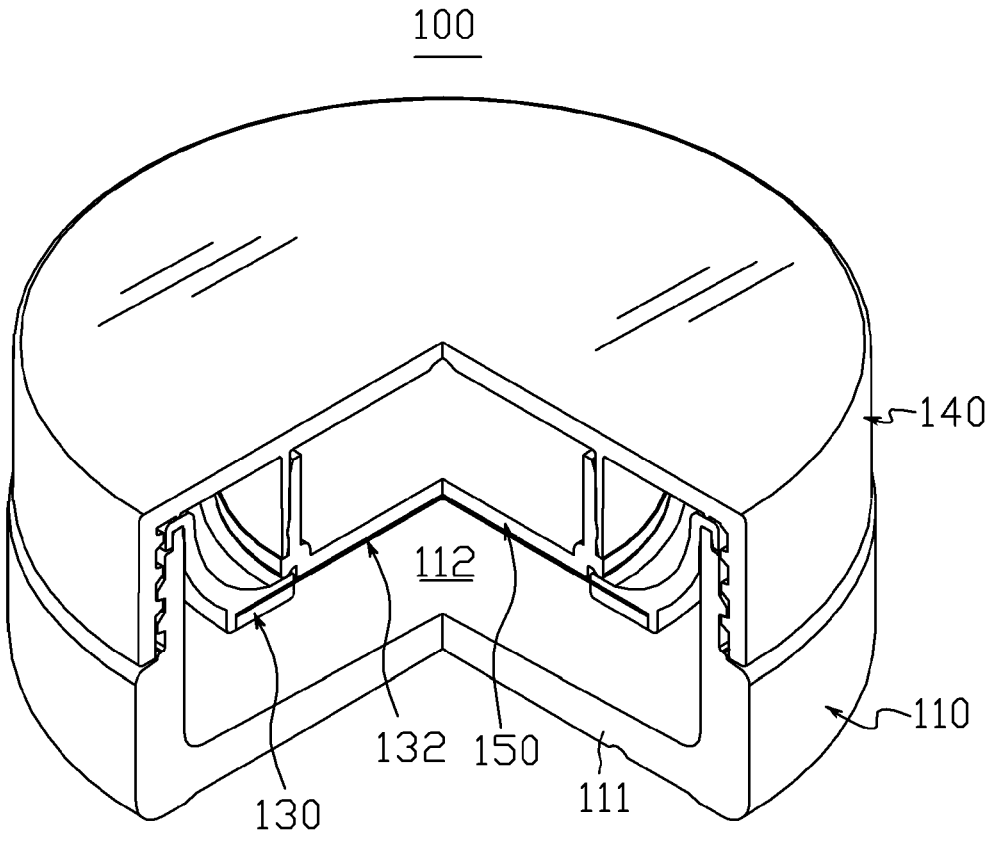
FIG. 3 is a partially sectioned perspective view illustrating the fully-assembled construction of a cosmetic powder container according to the first embodiment of the present invention.

In order to achieve the above object, the cosmetic powder container according to the present invention has the following technical characteristics.

The cosmetic powder container according to the first embodiment of the present invention is characterized in that it includes a container body having a powder chamber for containing cosmetic powder used as a beautifier, the powder chamber being open upwards; a middle cap seated on an upper end of the container body and defining therein a powder application space for applying the cosmetic powder to a make-up utensil, with a powder discharging part provided in a bottom of the middle cap for discharging the powder from the container body, the powder discharging part comprising a flexible mesh or perforations and being depressed to a predetermined depth relative to an upper surface of the bottom of the middle cap by a sealing step; an outer cap removably fastened to the upper end of the container body so as to seal the middle cap from the atmosphere, with an annular sealing protrusion formed downwards on a lower surface of the outer cap in such a way that the protrusion can be brought into close contact with an upper end of the middle cap; and a sealing cap integrally assembled with a locking collar formed on the lower surface of the outer cap, with an annular sealing foot formed on a lower surface of a bottom of the sealing cap so as to be closely seated on an upper surface of an outer shoulder of the powder discharging part when the outer cap is closed to the container body, and with a sealing bottom formed inside the annular sealing foot and fitted into the sealing step so as to close the powder discharging part.

According to the first embodiment of the present invention, a vertical side surface of the sealing bottom of the sealing cap is characterized in that it comes into close vertical contact with a vertical side surface of the sealing step of the middle cap.

According to the first embodiment of the present invention, the side surface of the sealing bottom of the sealing cap is characterized in that it is inclined and comes into inclined close contact with an upper end corner of a vertical side surface of the sealing step of the middle cap.

According to the first embodiment of the present invention, the lower surface of the sealing bottom of the sealing cap integrated with the outer cap is characterized in that it further includes a powder spreading depression for evenly spreading the powder applied to the make-up utensil over the make-up utensil.

According to the second embodiment of the present invention, the cosmetic powder container is characterized in that it further includes a powder charge opening formed in the bottom of the container body of the cosmetic powder container according to the first embodiment, and the powder charge opening is sealed by a powder charge cap after the container body has been charged with powder.

According to the second embodiment of the present invention, the side surface of the sealing bottom of the sealing cap is characterized in that it is shaped in the form of a vertical side surface which comes into vertical close contact with the vertical side surface of the sealing step of the middle cap.

According to the second embodiment of the present invention, the side surface of the sealing bottom of the sealing cap is characterized in that it is shaped in the form of an inclined side surface which comes into inclined close contact with the upper end corner of the vertical side surface of the sealing step of the middle cap.

According to the second embodiment of the present invention, the lower surface of the sealing bottom of the sealing cap integrated with the outer cap is characterized in that it further includes a powder spreading depression for evenly spreading the powder applied to the make-up utensil over the make-up utensil.

According to the third embodiment of the present invention, the cosmetic powder container is characterized in that it includes: a container body defining therein a powder chamber for containing powder that is a beautifier; a middle cap seated in an upper end of the container body, with a powder discharging part comprising a flexible mesh mounted to a sealing step defined in a central area of the middle step in such a way that the powder discharging part is stepped downwards, so that a user can use the powder by pressing a make-up utensil, such as a powder brush, against the flexible mesh and applying the powder contained in the powder chamber to the make-up utensil; and an outer cap openably fastened to an upper part of the container body, with a locking collar formed in a central area of a lower part of the outer cap and a sealing cap having a sealing bottom mounted to the locking collar, wherein the powder discharging part of the middle cap can be opened or closed by the sealing cap in response to an open or closing motion of the outer cap.

According to the third embodiment of the present invention, the sealing cap locked to the locking collar of the outer cap is characterized in that it is configured to be locked to the locking collar by an annular groove formed in an upper end of the sealing bottom, with an annular sealing foot protruding from the outer circumference of the sealing step so as to come into close contact with the upper surface of the middle cap and thereby to seal the powder discharging part.

According to the third embodiment of the present invention, the lower central area of the sealing cap is characterized in that it is further provided with a powder spreading depression for allowing a user to turn the make-up utensil, such as a powder brush, against the depression so as to evenly spread the cosmetic powder applied to the make-up utensil over the make-up utensil.

According to the third embodiment of the present invention, the bottom of the powder chamber of the container body is characterized in that it includes a concave surface which is concaved in the direction of the center of the bottom.

[Mode for Invention]

The cosmetic powder containers 100, 200 and 300 according to the first to third embodiments of the present invention will be sufficiently understood with reference to the accompanying drawings. Further, it should be understood that the technical terms used in the present invention may have various uses so long as the technical terms do not disturb the interpretation of the technical scope of the present invention.

Hereinbelow, the cosmetic powder container 100 according to the first embodiment of the present invention will be described in detail with reference to FIG. 3 through FIG. 12.

As shown in FIG. 3 through FIG. 12, the cosmetic powder container 100 according to the first embodiment of the present invention includes a container body 100, which is open in a predetermined direction and defines therein a powder chamber 112 for containing therein powder P that is a beautifier;

a middle cap 130 seated on the open upper end of the container body and defining therein a powder application space 131 for applying the powder to a make-up utensil 120, the middle cap 130 having a powder discharging part 132, such as a powder discharging part comprising a flexible mesh 132*a* or perforations 132*b*, defined in the bottom of the middle cap for discharging the powder from the powder chamber of the container body, the powder discharging part 132 being depressed to a predetermined depth from the upper surface of the bottom of the middle cap 130 by a sealing step 133;

an outer cap 140 openably fastened to the upper part of the container body 110 so as to seal the middle cap 130, with an annular sealing protrusion 141 protruding downwards from the lower surface of the outer cap so as to come into close contact with the upper surface of the middle cap when the outer cap is closed to the container body; and a sealing cap 150 locked to a locking collar 142 formed in the outer cap, with an annular sealing foot 151 formed on the lower surface of the sealing cap so as to come into close contact with the upper surface of an outer shoulder of the powder discharging part 132 formed in the middle cap 130 in response to a closing motion of the outer cap relative to the container body, and with a sealing bottom 152 formed in the bottom of the sealing cap at a location inside the annular sealing foot and fitted into the sealing step 133 so as to close the powder discharging part 132 in response to the closing motion of the outer cap.

According to the present invention, it is preferred that the outer cap 140 be fastened to the container body 110 via a screw-type fastening method as shown in the drawings, however, it should be understood that the structure for fastening the outer cap to the container body may be changed to another one as desired.

Further, according to the present invention, the sealing cap 150 may be locked to the locking collar 142 of the outer cap 140 by a variety of locking methods. For example, another locking collar 153 may be provided in the sealing cap by extending it upwards from the upper end of the sealing bottom 152 and the locking collar 153 may be fitted into or fitted over the locking collar 142 of the outer cap 140 so as to be locked to the outer cap by an undercut fitting method.

Further, the sealing cap 150 may be integrally formed with the outer cap 140 into a single structure.

Hereinbelow, the state, in which the powder P is reliably kept in the powder chamber 112 of the container body 110 in a sealed state while the cosmetic powder container 100 according to the first embodiment of the present invention is being carried by a user, will be described in detail.

Figure 4:
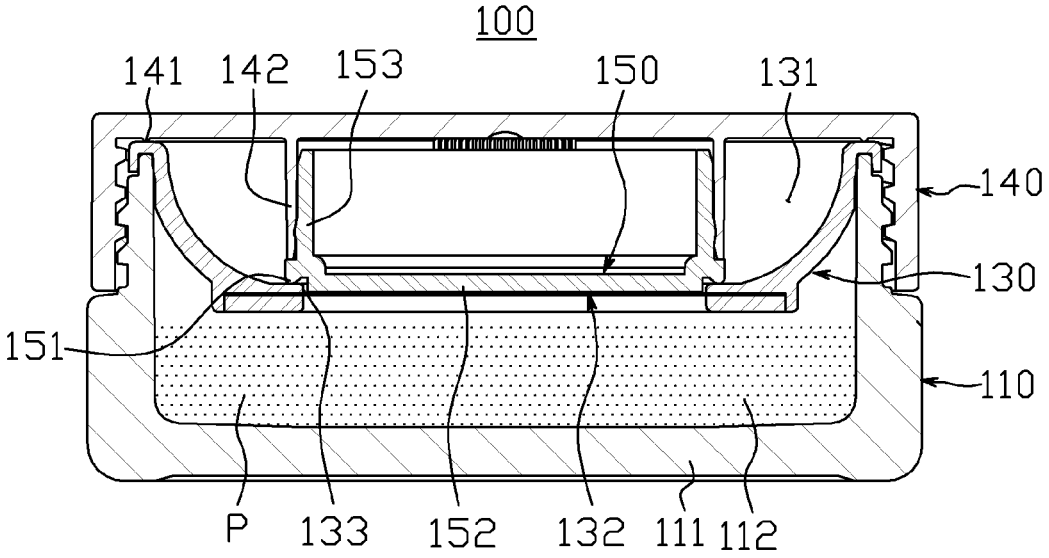
FIG. 4 is a cross-sectional view illustrating the fully-assembled construction of the cosmetic powder container according to the first embodiment of the present invention.
Figures 5A, 5B:
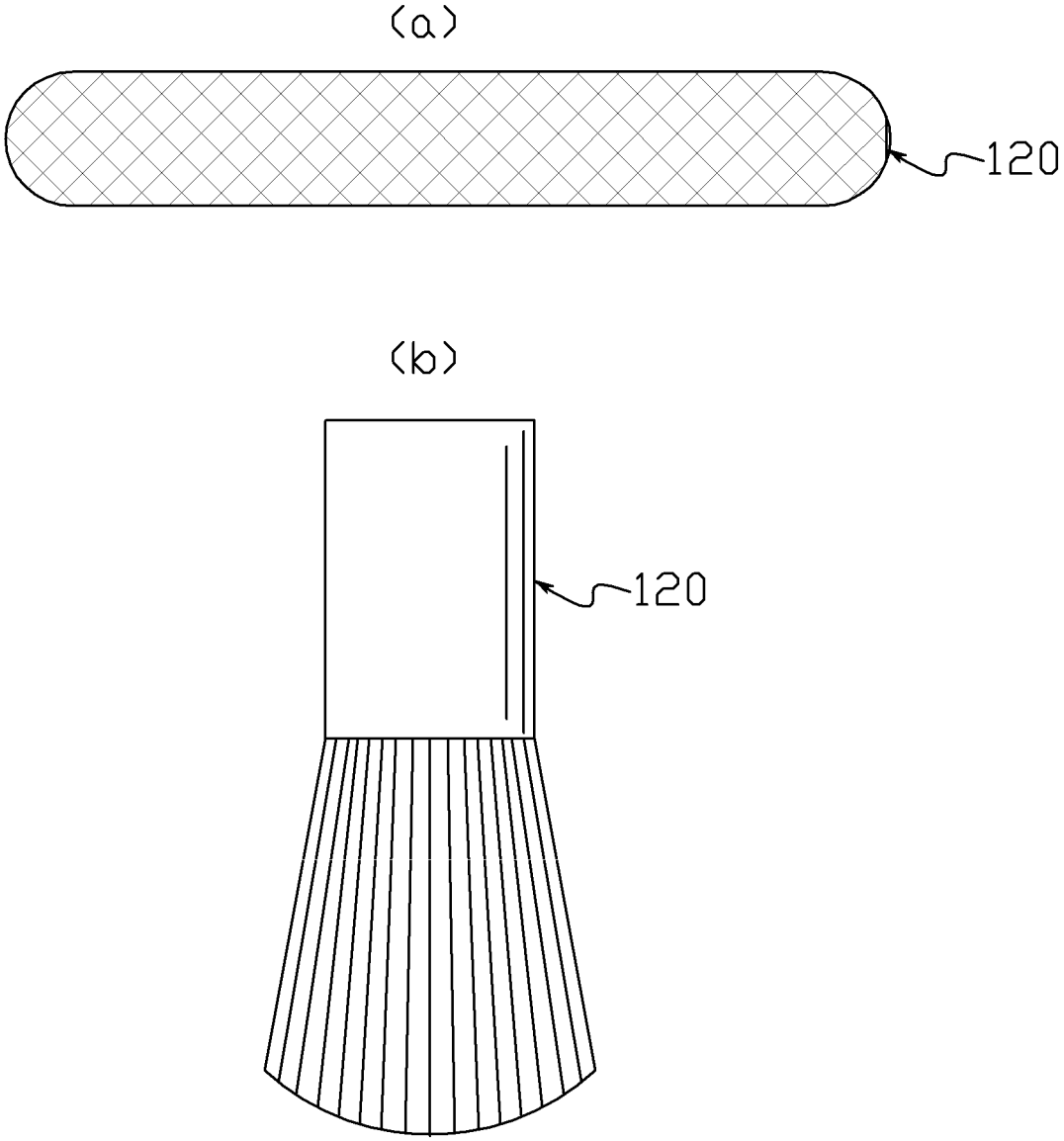
FIGS. 5(*a*) and 5(*b*) are front views of examples of make-up utensils, such as a powder puff and a make-up brush, used in the cosmetic powder container of the present invention.
Figures 6A, 6B:
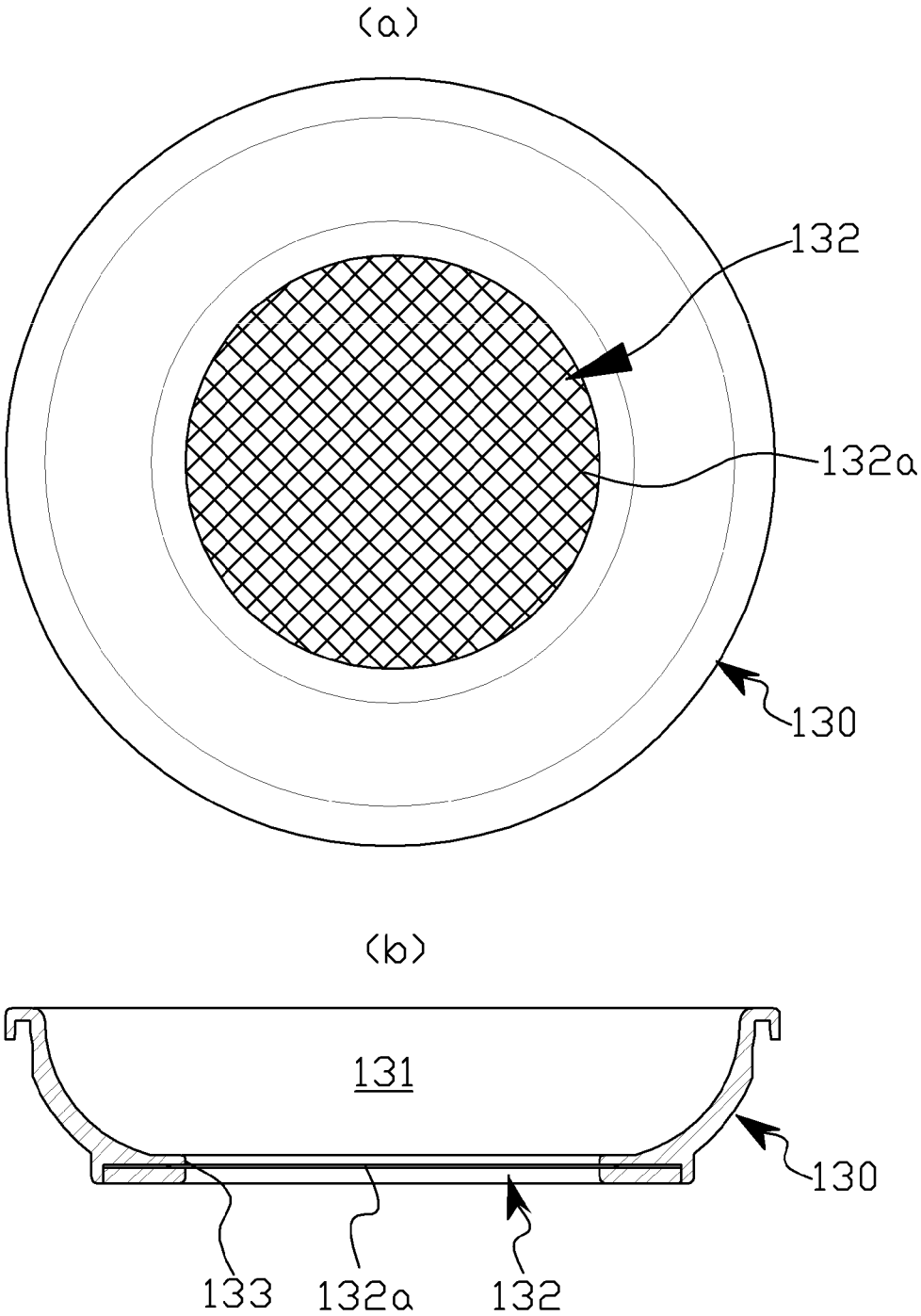
FIGS. 6(*a*) and 6(*b*) are a plan view and a cross-sectional view of a middle cap having a flexible mesh type powder discharging part according to the first embodiment of the present invention.
Figures 7A, 7B:
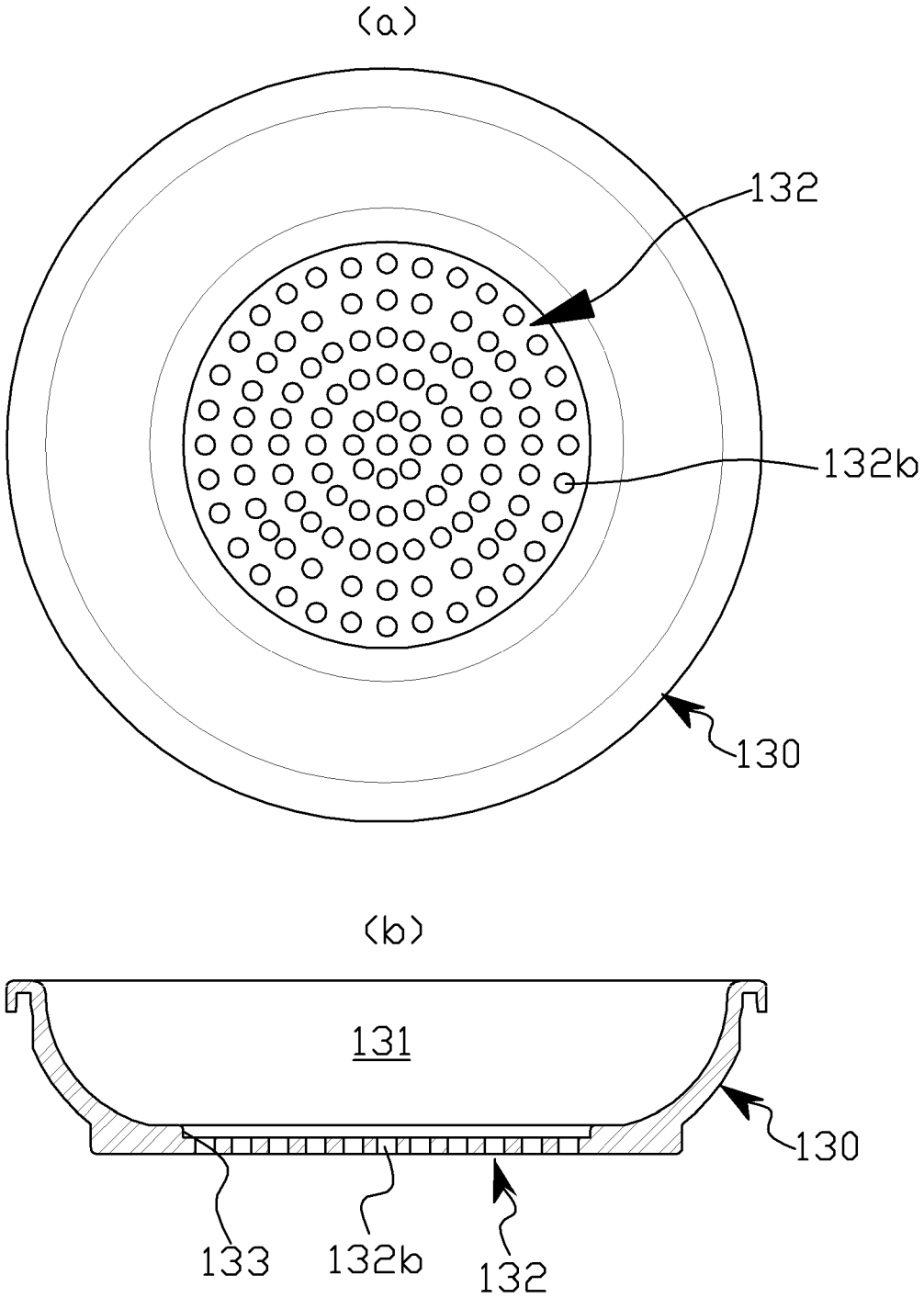
FIGS. 7(*a*) and 7(*b*) are a plan view and a cross-sectional view of a middle cap having a perforated type powder discharging part according to the first embodiment of the present invention.
Figure 8:
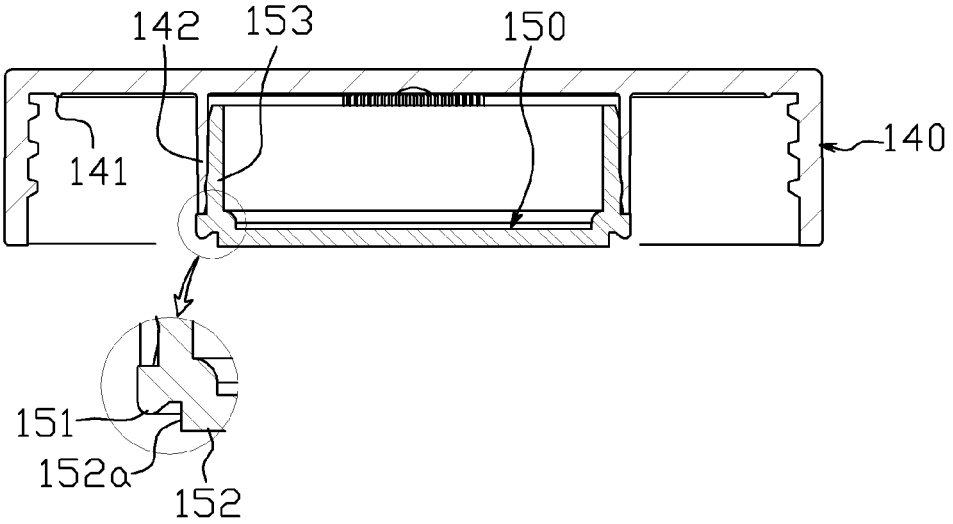
FIG. 8 is a sectional view of an outer cap according to the first embodiment of the present invention, in which the sealing bottom of a sealing cap is formed by a vertical side surface.
Figure 9:
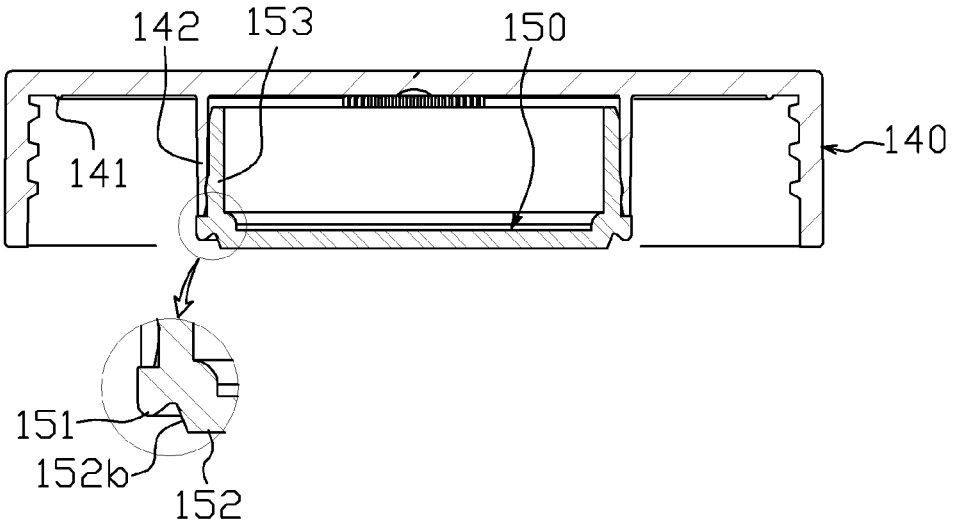
FIG. 9 is a sectional view of the outer cap according to the first embodiment of the present invention, in which the sealing bottom of the sealing cap is formed by an inclined side surface.

As shown in FIG. 4, when the fully assembled cosmetic powder container 100 is being carried by a user, the outer cap 140 can be maintained in a tightly closed state relative to the container body 110. Further, when the container body is closed by the outer cap 140 as described above, the stepped powder discharging part 132 provided in the middle cap 130 can be closed by the sealing bottom 152 of the sealing cap 150. Further, when the outer cap 140 is closed to the container body, the middle cap 130 and the powder discharging part 132 can be brought into close contact with the annular sealing protrusion 141 of the outer cap and the annular sealing foot 151 of the sealing cap 150, respectively.

Therefore, according to the first embodiment, when the cosmetic powder container 100 is being carried by a user, the powder P contained in the powder chamber 112 of the container body 110 can be kept in a sealed state because the powder discharging part 131 of the middle cap 130 is closed by the sealing bottom 152 of the sealing cap 150 that is locked to the outer cap 140 and, at the same time, the upper surfaces of the outer parts of both the middle cap 130 and the powder discharging part 132 are closed by the annular sealing protrusion 141 of the outer cap 140 and by the annular sealing foot 151 of the sealing cap 150, respectively. Accordingly, if the outer cap 140 is not intentionally opened by the user, it is possible to reliably prevent the powder P from leaking out of the powder chamber 112 of the container body 110, so that the user can cleanly and hygienically use the cosmetic powder container while carrying it.

Figure 10A:
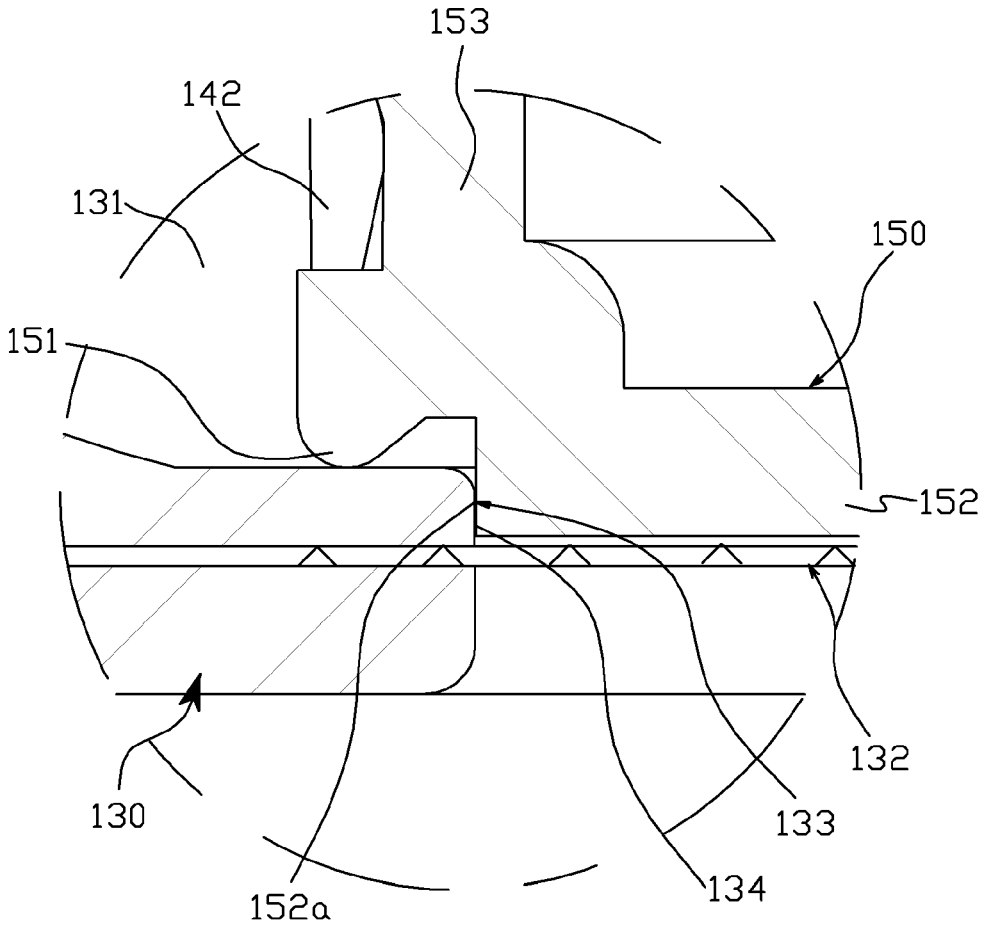
FIG. 10*a* is a partially enlarged sectional view illustrating vertical engagement of the sealing cap relative to a sealing step of the middle cap according to the first embodiment of the present invention.
Figure 10B:
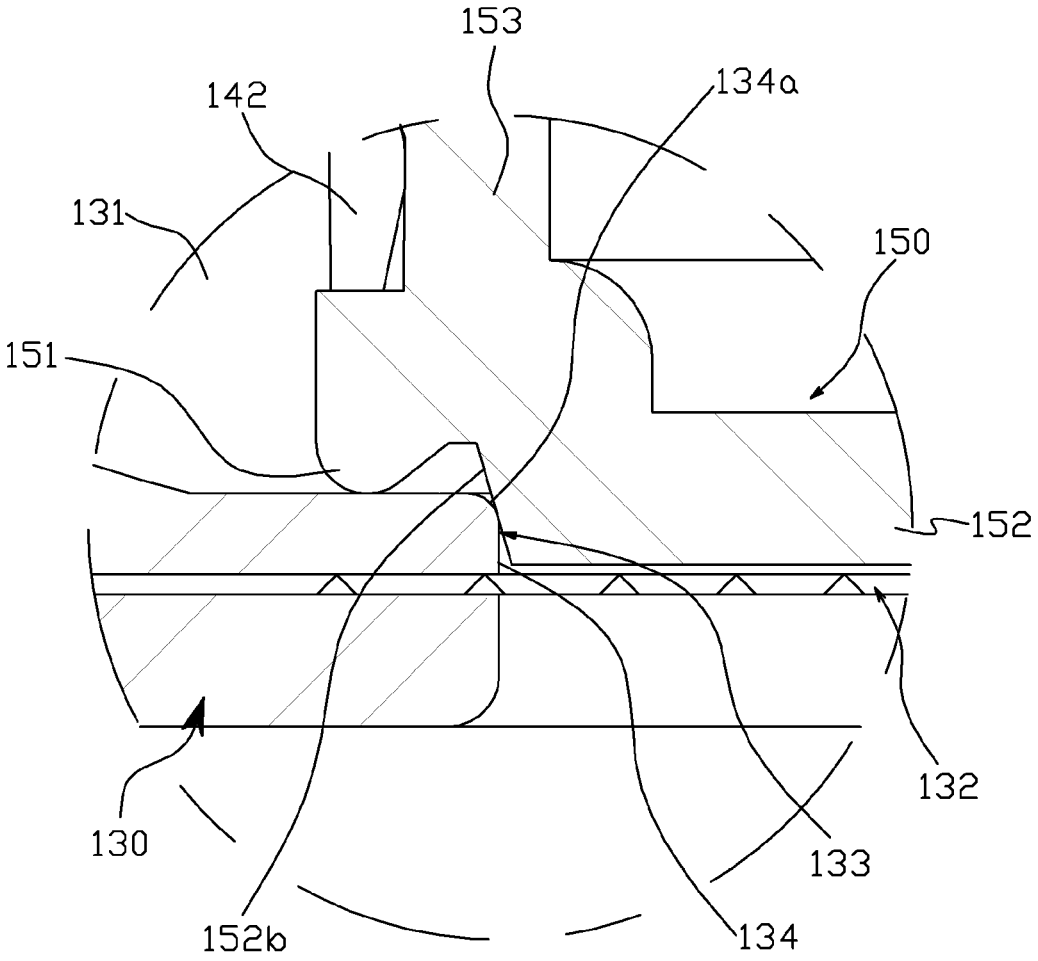
FIG. 10*b* is a partially enlarged sectional view illustrating inclined engagement of the sealing cap relative to the sealing step of the middle cap according to the first embodiment of the present invention.

Further, in the cosmetic powder container according to the first embodiment of the present invention, the powder discharging part 132 of the middle cap 130 can be maintained in a reliable sealing state as shown in FIG. 10*a* and FIG. 10*b*.

As shown in FIG. 10*a*, to seal the powder discharging part 132 of the middle cap 130, the side surface of the sealing bottom 152 of the sealing cap 150 may be shaped in the form of a vertical side surface 152*a* which can be brought into vertical close contact with the vertical side surface 134 formed in the sealing step 133 of the middle cap. In the above case, it is preferred that the inner diameter of the vertical side surface 134 of the sealing step 133 be configured to be almost equal to the outer diameter of the vertical side surface 152*a* of the sealing bottom 152 of the sealing cap 150. Therefore, when the outer cap 140 is closed to the container body, no gap remains between the vertical side surface 152*a* of the sealing cap 150 and the vertical side surface 134 of the sealing step 133 because the two vertical side surfaces come into close surface contact with each other, so that the sealing bottom 152 of the sealing cap 150 can reliably close the powder discharging part 131 and can reliably prevent the powder P from leaking out of the container body.

Further, as shown in FIG. 10*b*, the structure to seal the powder discharging part 132 of the middle cap 130 may be realized by shaping the side surface of the sealing bottom 152 of the sealing cap 150 in the form of an inclined side surface 152*a* which can come into inclined close contact with the upper end corner 134*a* of the vertical side surface 134 of the sealing step 133 formed in the middle cap 130. In the above case, when the outer cap 140 is closed to the container body, the inclined side surface 152*a* of the sealing bottom 152 provided in the sealing cap 150 functioning to seal the powder discharging part 132 comes into inclined close contact with the upper end corner 134*a* of the vertical side surface 134 of the sealing step 133. Therefore, although there occurs some sealing deviation in the annular sealing protrusion 141 of the outer cap 140 or in the annular sealing foot 151 of the sealing cap 150 when the outer cap is closed, the above-mentioned structure allows no gap to remain between the upper end corner 134*a* of the sealing step 133 and the inclined side surface of the sealing cap, thereby reliably preventing powder P from leaking out of the container body.

Hereinbelow, the application of make-up to the skin of a user using the cosmetic powder container of the present invention by discharging powder P from the powder chamber 112 of the container body 110 after opening the outer cap 140 from the container body 110 will be described in detail with reference to FIG. 11 and FIG. 12.

Figure 11:
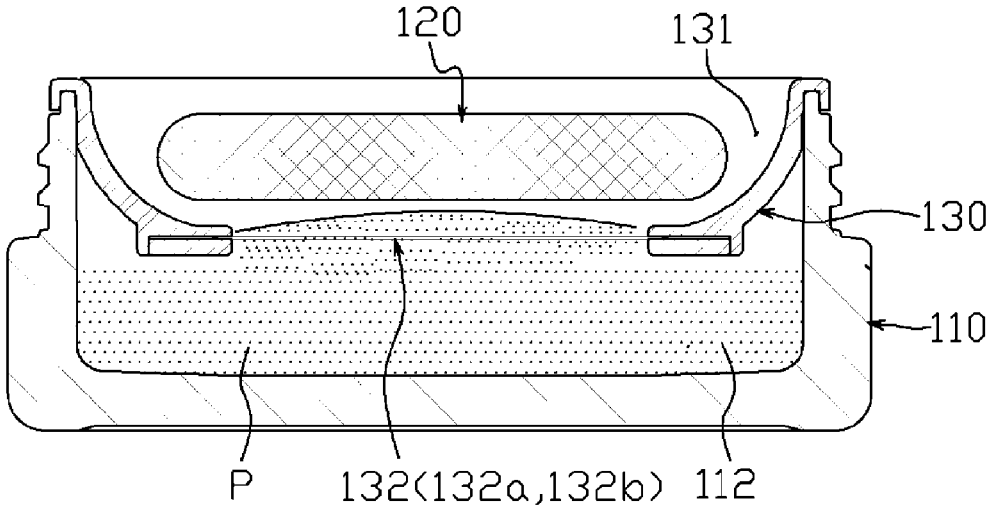
FIG. 11 is a side sectional view illustrating a state in which the outer cap of the cosmetic powder container according to the first embodiment of the present invention was removed from a container body and powder is discharged through the powder discharging part of the middle cap to be used for applying make-up to the skin.

First, as shown in FIG. 11, to discharge the cosmetic powder and to apply the powder to the skin of a user, the outer cap 140 is removed from the container body 110 so that the powder discharging part 132 of the middle cap 130 is opened. In other words, when the outer cap 140 is removed from the container body, the sealing cap 150 is also removed from the powder discharging part 132, thus opening the powder discharging part 132. Thereafter, when the container body 110 in the above state is gently moved while holding it with one hand, the powder P is discharged from the powder chamber 112 of the container body 110 onto the upper surface of the bottom of the middle cap 130 through the powder discharging part 132 comprising the flexible mesh 132*a* or the perforations 132*b*. The cosmetic powder which has been discharged onto the upper surface of the middle cap may be applied to the skin of the user using the make-up utensil 120, such as a powder puff or a make-up brush. When the user prefers to discharge the powder from the container body by moving the container body with one hand prior to applying the powder to the skin as described above, it is preferred that the powder discharging part 132 comprise the perforations 132*b*.

In addition to the above-mentioned powder discharging method, there may be another method of discharging the powder, in which a powder puff type make-up utensil 120 is laid in the powder application space 131 defined on the powder discharging part 132 of the middle cap 130 and the container body 110 is moved with one hand, thereby discharging the powder from the container body to the make-up utensil and applying it to the utensil.

Figure 12:
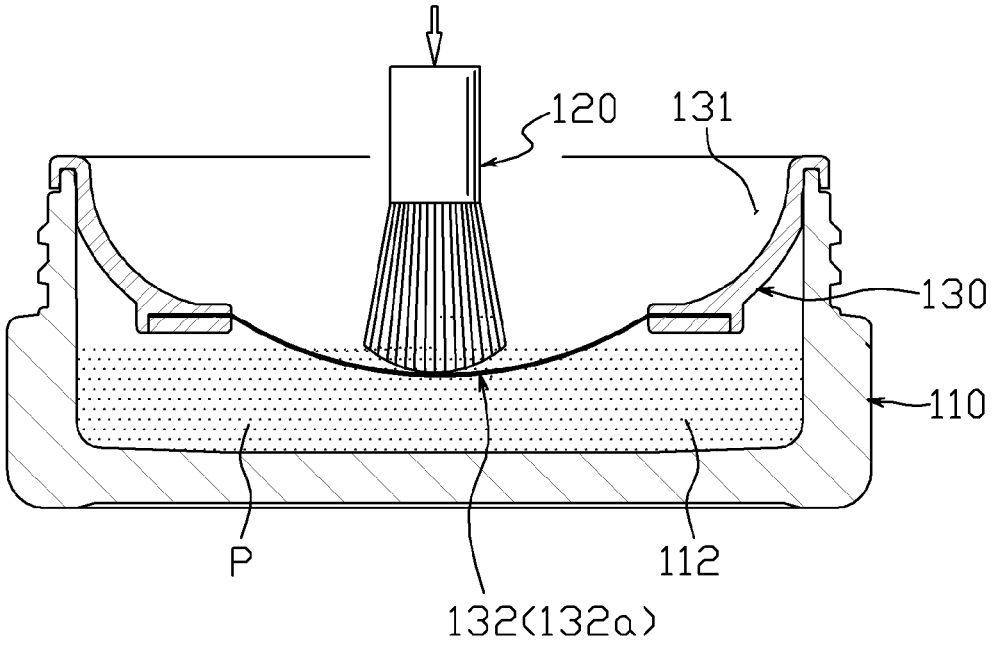
FIG. 12 is a side sectional view illustrating a state in which the outer cap of the cosmetic powder container according to the first embodiment of the present invention was removed from the container body and powder is applied to a make-up utensil by pressing the utensil against the powder discharging part of the middle cap so as to be used for applying make-up to the skin when the powder discharging part is a flexible mesh type part.

Further, when the powder discharging part 132 is realized using the flexible mesh 132*a*, as shown in FIG. 12, a method of discharging the powder may be used, in which the powder contained in the powder chamber 112 of the container body 110 may be applied to the make-up utensil 120 by pressing the make-up utensil against the flexible mesh 132*a*. Particularly, when the powder P is applied to the make-up utensil 120 by pressing the make-up utensil 120 to the flexible mesh 131*a* constituting the powder discharging part 132, it is preferred to use a powdered beautifier as the cosmetic powder, however, this method may be also efficiently used with semisolid compressed cosmetic powder.

Figure 13:
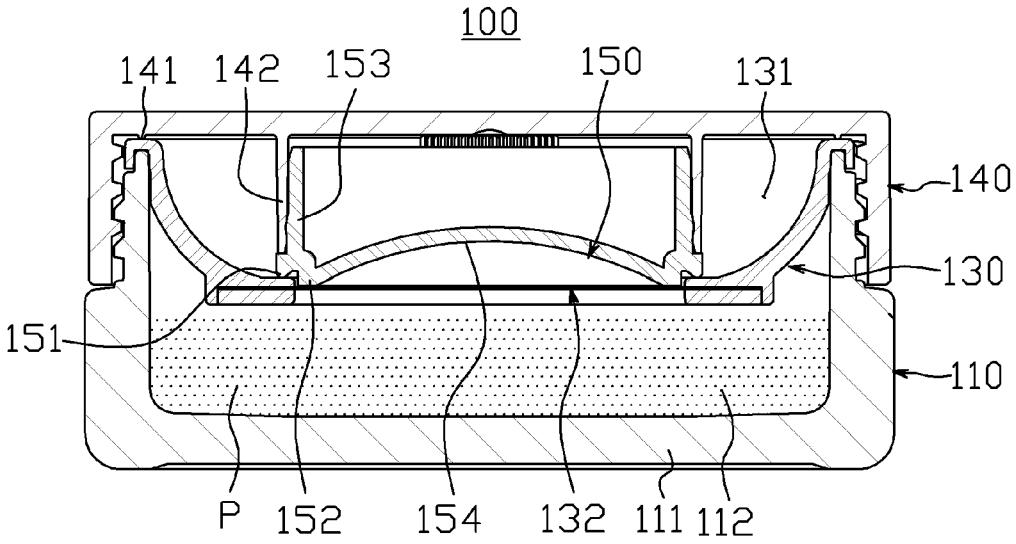
FIG. 13 is a sectional view of an assembled sealing cap according to a modification of the first embodiment of the present invention.

Further, when make-up is performed by applying the powder P contained in the cosmetic powder container 100 according to the first embodiment to the make-up brush type make-up utensil 120, the lower surface of the sealing bottom 152 of the sealing cap 150 locked to the outer cap 140 may be provided with a powder spreading depression 154 for evenly spreading the cosmetic powder over the make-up brush, as shown in FIG. 13.

Figure 14:
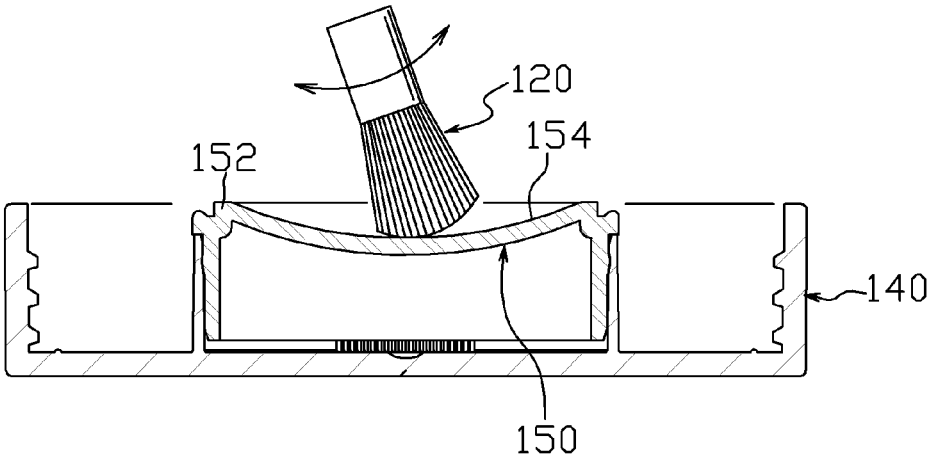
FIG. 14 is a sectional view illustrating a using state of the sealing cap of FIG. 11.

When the construction of the cosmetic powder container is configured as described above and make-up is applied to the skin of a user using the make-up brush type make-up utensil 120, although the powder P which has been primarily applied to the make-up brush is not evenly distributed over the brush, a user may hold the make-up brush with one hand and turns the make-up brush against the powder spreading depression 154 while holding the outer cap 140 in an upturned state with the other hand as shown in FIG. 14, so that the powder which has been unevenly distributed over the make-up brush can be evenly spread on the brush, thus allowing the user to more quickly and easily apply make-up.

Figure 15:
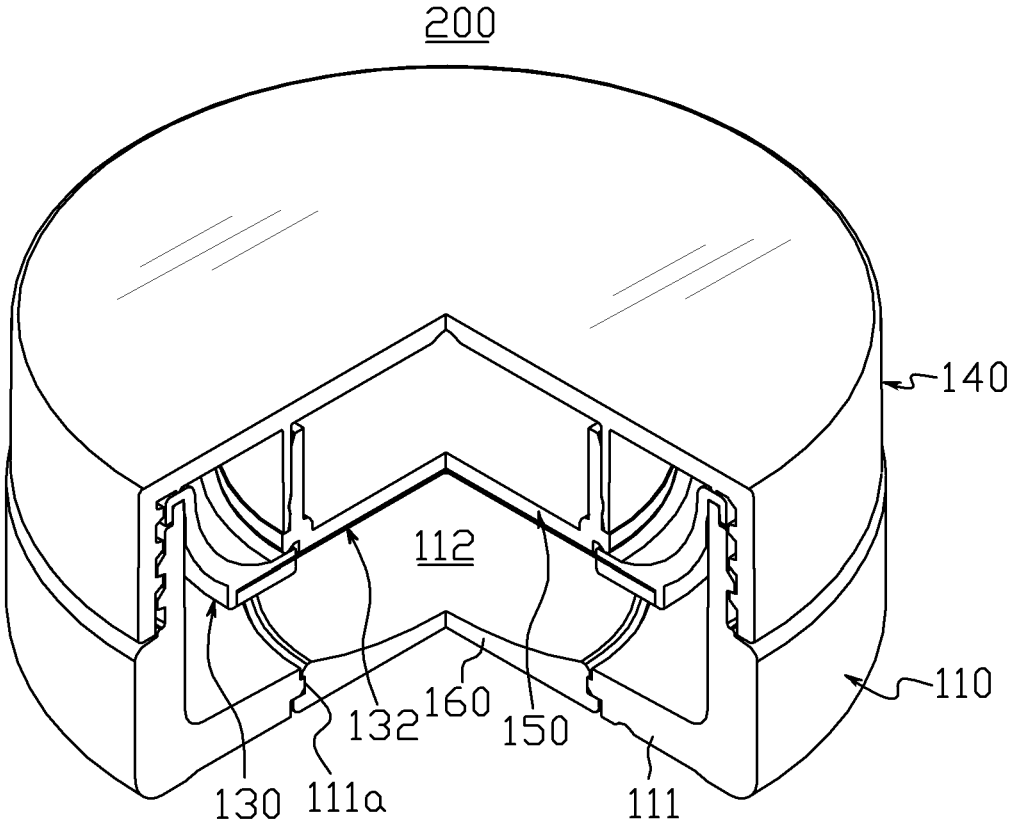
FIG. 15 is a partially broken perspective view illustrating the fully-assembled construction of a cosmetic powder container according to the second embodiment of the present invention.
Figure 16:
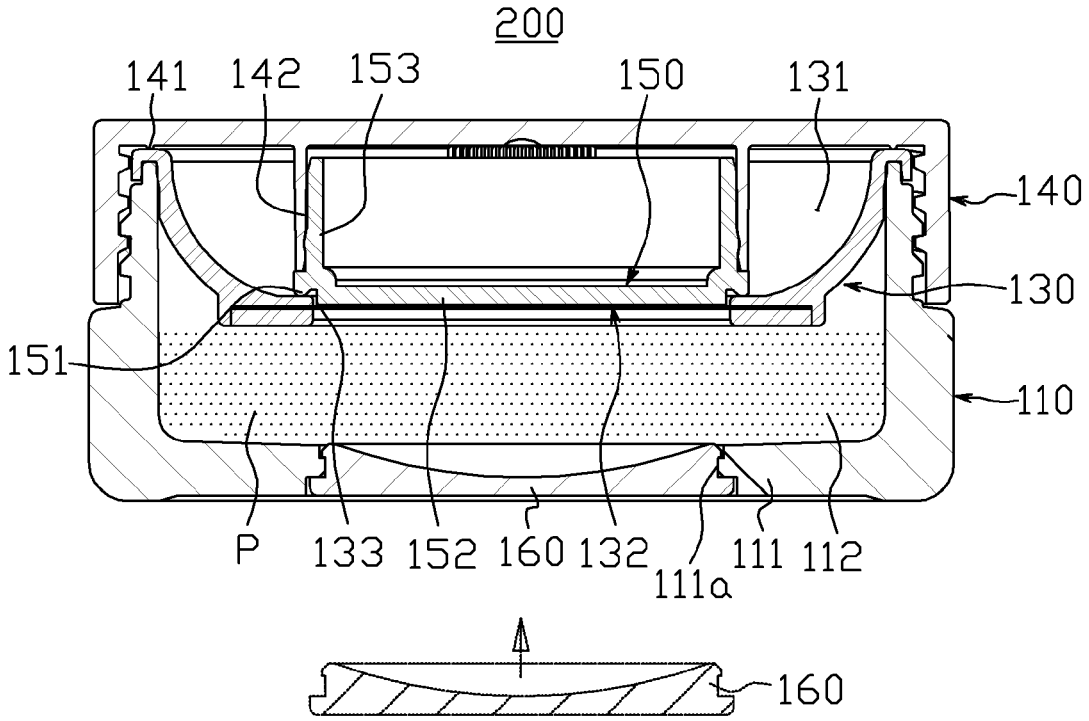
FIG. 16 is a side sectional view illustrating the fully-assembled construction of the cosmetic powder container according to the second embodiment of the present invention.
Figure 17:
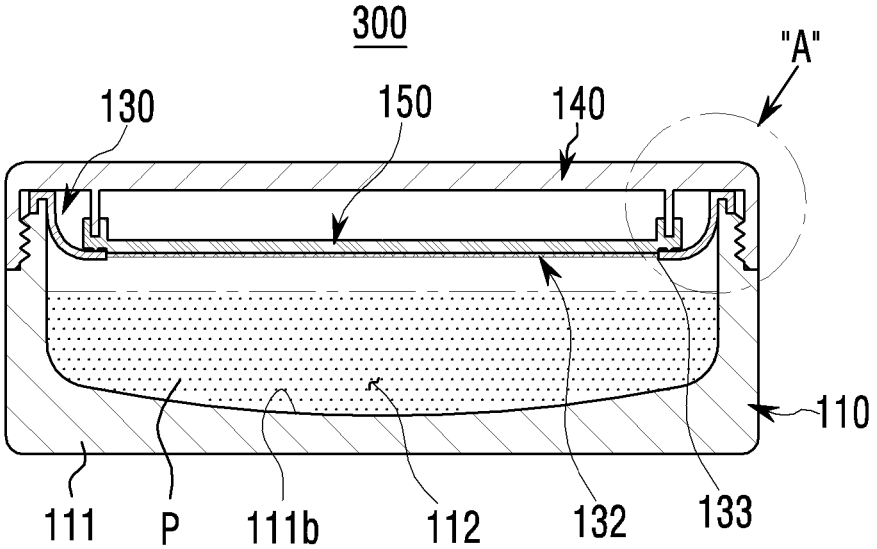
FIG. 17 is a side sectional view illustrating the fully-assembled construction of a cosmetic powder container according to the third embodiment of the present invention.
Figure 18:
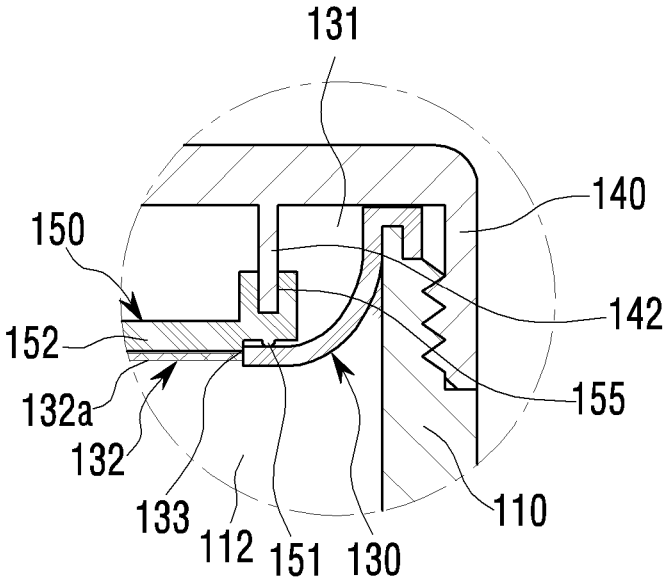
FIG. 18 is an enlarged sectional view of portion A of FIG. 15.
Figure 19:
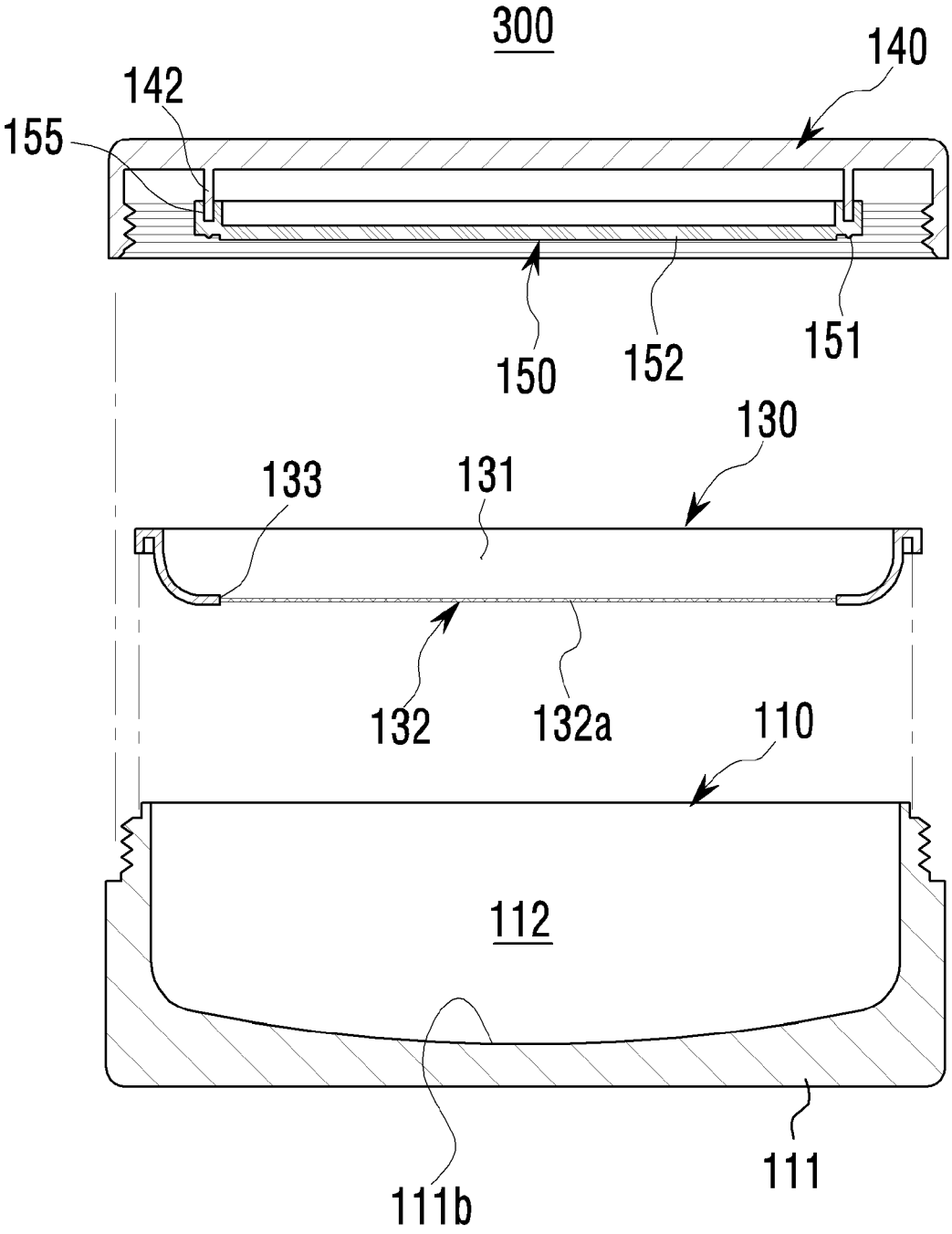
FIG. 19 is an exploded sectional view of the cosmetic powder container according to the third embodiment of the present invention.
Figure 20:
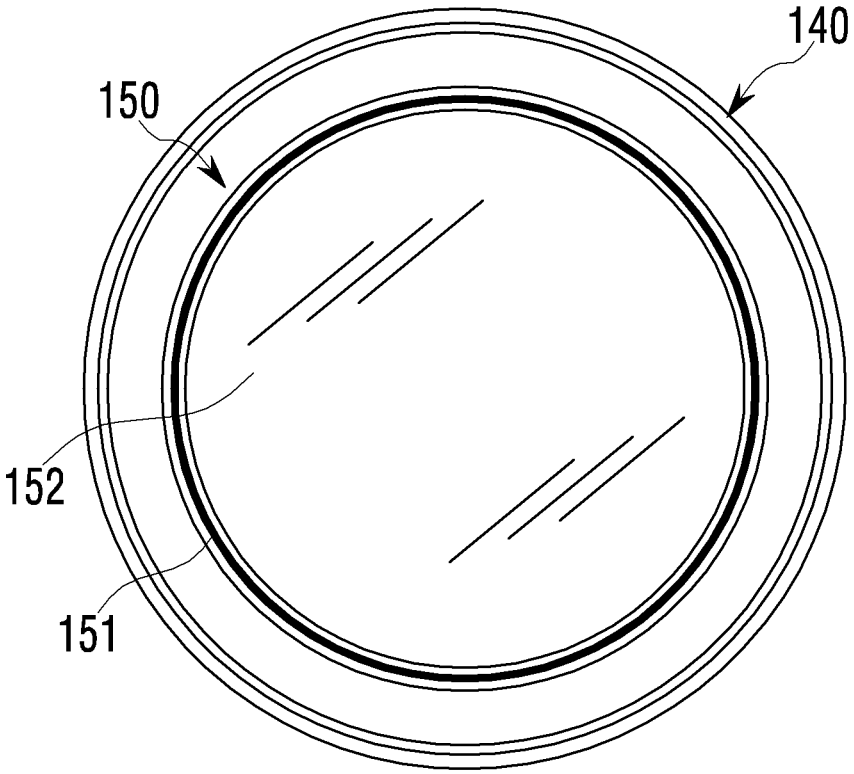
FIG. 20 is a bottom view of a middle cap according to the third embodiment of the present invention.
Figure 21:
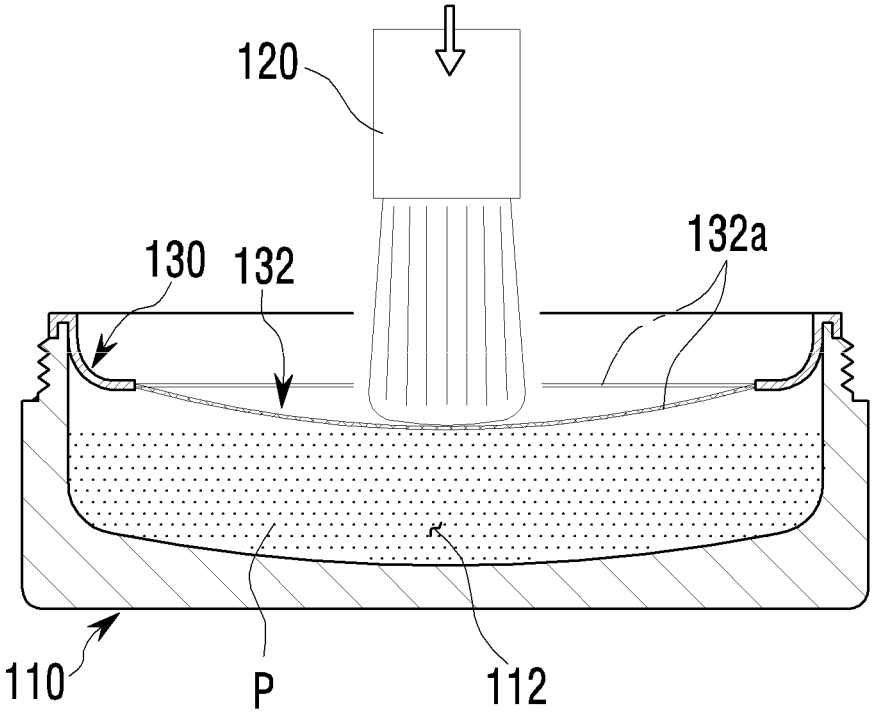
FIG. 21 is a sectional view illustrating a using state of the cosmetic powder container according to the third embodiment of the present invention.
Figure 22:
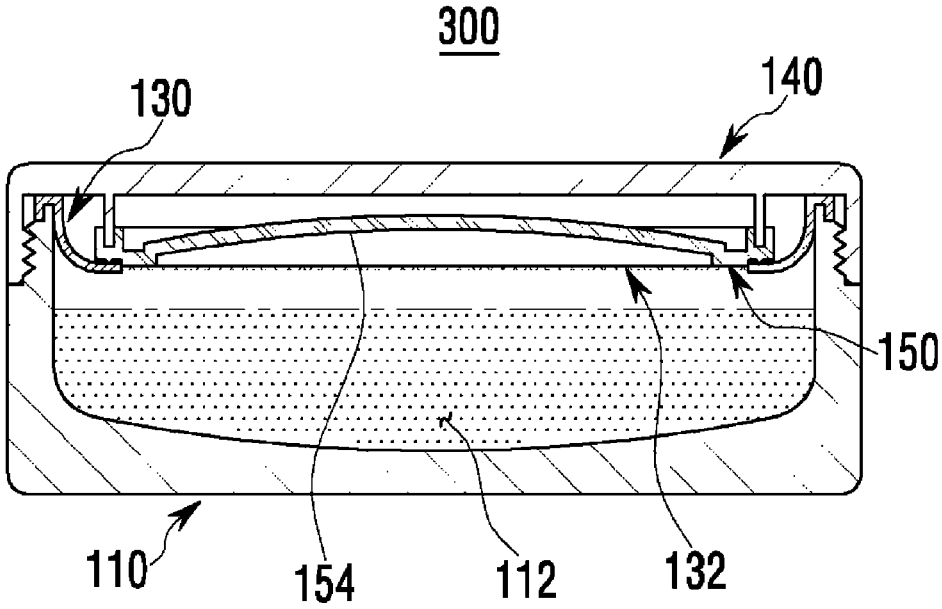
FIG. 22 is a sectional view illustrating the assembled construction of a sealing cap of the cosmetic powder container according to a modification of the third embodiment of the present invention.
Figure 23:
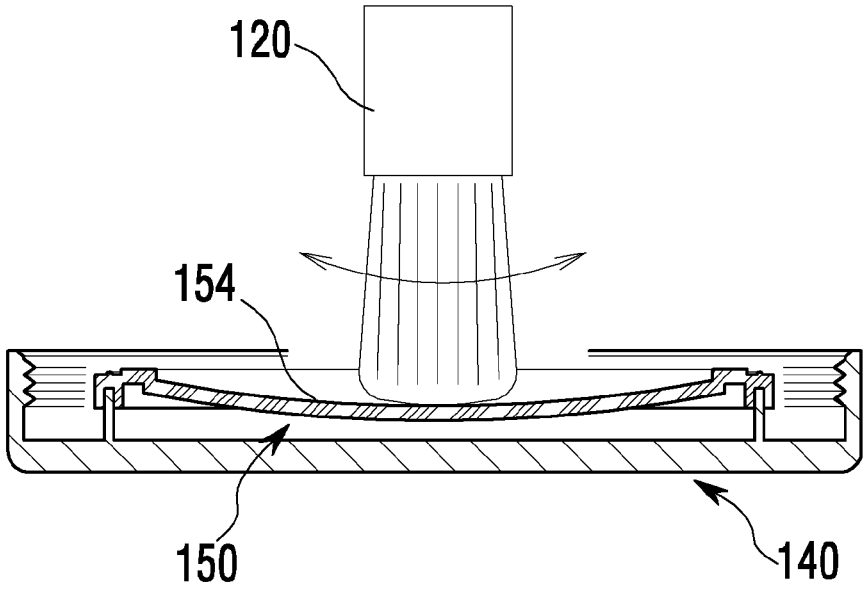
FIG. 23 is a sectional view illustrating a using state of the sealing cap shown in FIG. 22.

Hereinbelow, the cosmetic powder container 200 according to the second embodiment of the present invention will be described with reference to FIG. 15 and FIG. 16.

In the following description for the cosmetic powder container according to the second embodiment, those elements common to both the cosmetic powder container 100 of the first embodiment and the cosmetic powder container according to the second embodiment will carry the same reference numerals and further explanation of the detailed construction of those elements may be omitted for realizing an easy description and preventing repetition of the description.

When comparing the cosmetic powder container 200 of the second embodiment to the cosmetic powder container 100 of the first embodiment, the general shape of the second embodiment remains the same as in the first embodiment, but a powder charge opening 111*a* is formed in the bottom 111 of the container body 110 for charging cosmetic powder P into the container body and a powder charge cap 160 is provided for closing the powder charge opening after charging the cosmetic powder into the container body.

Therefore, in the second embodiment, when the cosmetic powder container 200 is being carried by a user, the function of sealing the powder discharging part 132 of the middle cap 130 or the function realized by opening the outer cap 140 may stay the same as those described in the cosmetic powder container 100 of the first embodiment.

Further, in the cosmetic powder container 200 according to the second embodiment, a powder charge opening 111*a* may be formed in the bottom 111 of the container body 110 such that powder can be charged into the container body through the powder charge opening and the opening can be closed by a powder charge cap 160 after completely charging the powder into the container body. Therefore, powder charging work using a powder charging machine can be automatically performed so that the powder charging process can be simplified and require a reduced number of workers, thereby realizing a reduction in the labor cost.

Hereinbelow, the cosmetic powder container 300 according to the third embodiment will be described with reference to FIG. 17 through FIG. 23.

In the following description for the cosmetic powder container 300 according to the third embodiment shown in FIGS. 17 through 23, those elements common to the cosmetic powder container according to the third embodiment and to the cosmetic powder containers 100 and 200 according to the first and second embodiments will carry the same reference numerals and further explanation of the detailed construction of those elements may be omitted for the sake of realizing an easy description and preventing repetition of the description.

The cosmetic powder container 300 according to the third embodiment includes a container body 110 defining therein a powder chamber 112 for containing powder P that is a beautifier; a middle cap 130 seated in the upper end of the container body, with a powder discharging part 132 comprising a flexible mesh 132*a* provided inside a sealing step 134 of the middle cap for allowing a user to use the powder P contained in the powder chamber 112 by pressing the flexible mesh using a make-up utensil 120, such as a powder brush; and an outer cap 140 openably fastened to the upper end of the container body, with a locking collar 142 provided on the central area of the lower surface of the outer cap 140 and a sealing cap 150 locked to the locking collar and functioning to open or close the sealing step 134 of the middle cap 130 in response to an opening or closing motion of the outer cap.

Here, the sealing cap 150 locked to the locking collar 142 of the outer cap is provided with an annular groove 155 which can be fitted over the locking collar 142. The lower central part of the sealing cap 150 is defined both by a sealing bottom 152, which can be fitted into the sealing step 134 of the middle cap 130 and seals the sealing step, and by an annular sealing foot 151 which circumferentially protrudes from a lower surface of the outer rim provided outside the sealing bottom so as to come into close contact with the upper surface of the middle cap and thereby seal the powder discharging part 132.

Further, the central area of the lower surface of the sealing cap 150 is provided with a powder spreading depression 154 for allowing a user to turn the make-up utensil 120, such as a powder brush, against the powder spreading depression so as to evenly spread the powder, which has been primarily applied to the make-up utensil 120, over the make-up utensil.

Further, the bottom 111 of the powder chamber 112 of the container body 110 is provided with a concave surface 111*b* which is concaved towards the center of the bottom, so that the powder can be collected in the central area of the bottom. Further, it is preferred that, in order to prevent accumulation of powder, the inside corner of the middle cap 130 be configured in the form of a round shape.

Hereinbelow, the operation and function of the cosmetic powder container 300 having the above-mentioned construction according to the third embodiment will be described.

First, powder P is charged into the powder chamber 112 of the container body 110 and the middle cap 130, which has the powder discharging part 132 comprising the flexible mesh 132*a* that is mounted to the sealing step 134 defined in the center of the upper part of the container body in such a way that the powder discharging part is stepped downwards, is inserted into the upper end of the container body, thereby being seated therein. Further, the outer cap 140 is tightened to the upper end of the container body 110 via a screw type engagement. When the outer cap 140 is tightened to the container body as described above, the sealing cap 150 provided in the outer cap seals the powder discharging part 132 because the sealing bottom 134 of the sealing cap is inserted into the sealing step 133 of the middle cap 130. Further, the annular sealing foot 151 formed outside the sealing step 133 comes into close contact with the upper surface of the middle cap 130, thereby preventing the powder P from leaking out of the container body.

Accordingly, in the cosmetic powder container 300 according to the third embodiment, the powder discharging part 132 provided in the sealing step 133 of the middle cap 130 can be reliably sealed by the sealing cap 150 of the outer cap 140, so that, when the powder container is being carried by a user, the powder P contained in the powder container can be prevented from leaking out, thereby preventing loss of the powder and preventing the leaked powder from contaminating the surroundings.

Further, when the outer cap 140 of the cosmetic powder container 300 is opened from the container body 110 so as to apply make-up, the powder discharging part 132 provided in the sealing step 133 of the middle cap 130 can be opened in response to the opening motion of the outer cap 140. Therefore, the powder P contained in the powder chamber 112 of the container body 110 can be used to apply make-up by elastically pressing the make-up brush type make-up utensil 120 against the powder discharging part 132 having the flexible mesh 132*a* provided in the middle cap 130. Here, the powder may use a powdered beautifier or compressed cosmetic powder.

Here, when the cosmetic powder is not evenly applied to the make-up utensil 120, such as a the powder brush, a user may turn the make-up utensil against the powder spreading depression formed in the sealing cap 150 of the outer cap, thereby evenly spreading the powder, which has been applied to the make-up utensil, over the make-up utensil and allowing the user to quickly and evenly apply make-up.

Further, the bottom 111 of the powder chamber 112 of the container body 110 is provided on the upper surface with the concave surface 111*b* which is concaved toward the center of the bottom, so that the cosmetic powder can naturally collect in the central area on the bottom and thereby the cosmetic powder can be completely used without leaving remnants behind in the container body.

According to the above-mentioned construction of the cosmetic powder container 100, 200, 300 according to the first, second and third embodiments of the present invention, when the powder container is being carried by a user, the flexible mesh type or perforated type powder discharging part 132 provided for discharging the cosmetic powder can be reliably sealed by the sealing cap 150 of the outer cap 140, so that it is possible to prevent powder from leaking out of the container body, thereby preventing loss of powder and allowing the user to hygienically carry the powder container. Further, when it is required to apply make-up, the powder discharging part 132, which has been kept in a sealed state, can be quickly opened in response to an opening motion of the outer cap 140 from the container body 110, so that the user can quickly and easily apply make-up using the powder.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A cosmetic powder container, comprising:

a container body (110) having a powder chamber (112) for containing cosmetic powder (P) used as a beautifier, the powder chamber being open upwards;

a middle cap (130) seated on an upper end of the container body and defining therein a powder application space (131) for applying the cosmetic powder to a make-up utensil (120), with a powder discharging part (132) provided in a bottom of the middle cap for discharging the powder from the container body, the powder discharging part comprising a flexible mesh (132*a*) or perforations (132*b*), the powder discharging part (132) being depressed to a predetermined depth relative to an upper surface of the bottom of the middle cap by a sealing step (133);

an outer cap (140) removably fastened to the upper end of the container body (110) so as to seal the middle cap (130) from an outside atmosphere, with an annular sealing protrusion (141) formed on a lower surface of the outer cap in such a way that the protrusion can be brought into close contact with an upper end of the middle cap; and a sealing cap (150) integrally assembled with a locking collar (142) formed on the lower surface of the outer cap, with an annular sealing foot (151) formed on a lower surface of a bottom of the sealing cap so as to be closely seated on an upper surface of an outer shoulder of the powder discharging part (132) when the outer cap is closed to the container body, and with a sealing bottom (152) formed inside the annular sealing foot and fitted into the sealing step (133) so as to close the powder discharging part (132), wherein the sealing cap (150) locked to the locking collar (142) of the outer cap (140) is provided with a locking collar (153), the locking collar (153) extending from an upper surface of the sealing bottom (152) and being locked by the locking collar (142) of the outer cap (140) through an undercut fitting method.

2. The cosmetic powder container as set forth in claim 1, wherein the sealing bottom (152) of the sealing cap (150) has a side surface configured in the form of a vertical side surface (152*a*) so as to come into vertical close contact with a vertical side surface (134) of the sealing step (133) provided in the middle cap (130).

3. The cosmetic powder container as set forth in claim 1, wherein the sealing bottom (152) of the sealing cap (150) has a side surface configured in the form of an inclined side surface (152*b*) so as to come into inclined close contact with an upper end corner (134*a*) of a vertical side surface (134) of the sealing step (133) provided in the middle cap (130).

4. The cosmetic powder container as set forth in claim 1, wherein the sealing bottom (152) of the sealing cap (150) provided in the outer cap (140) is provided on a lower surface thereof with a powder spreading depression (154) for evenly spreading powder, which has been applied to the make-up utensil, over the make-up utensil.

5. A cosmetic powder container, comprising:

a container body (110) having a powder chamber (112) for containing cosmetic powder (P) used as a beautifier, the powder chamber being open upwards;

a middle cap (130) seated on an upper end of the container body and defining therein a powder application space (131) for applying the cosmetic powder to a make-up utensil (120), with a powder discharging part (132) provided in a bottom of the middle cap for discharging the powder from the container body, the powder discharging part comprising a flexible mesh (132*a*) or perforations (132*b*), the powder discharging part (132) being depressed to a predetermined depth relative to an upper surface of the bottom of the middle cap by a sealing step (133);

an outer cap (140) removably fastened to the upper end of the container body (110) so as to seal the middle cap (130) from an outside atmosphere, with an annular sealing protrusion (141) formed on a lower surface of the outer cap in such a way that the protrusion can be brought into close contact with an upper end of the middle cap;

a sealing cap (150) integrally assembled with a locking collar (142) formed on the lower surface of the outer cap, with an annular sealing foot (151) formed on a lower surface of bottom of the sealing cap so as to be closely seated on an upper surface of an outer shoulder of the powder discharging part (132) when the outer cap is closed to the container body, and with a sealing bottom (152) formed inside the annular sealing foot and fitted into the sealing step (133) so as to close the powder discharging part (132); and a powder charge opening (111*a*) formed in a bottom (111) of the container body (110) such that the powder charge opening can be sealed by a powder charge cap (160) after powder has been charged in the container body through the powder charge opening.

6. The cosmetic powder container as set forth in claim 5, wherein the sealing cap (150) locked to the locking collar (142) of the outer cap (140) is provided with a locking collar (153), the locking collar (153) extending from an upper surface of the sealing bottom (152) and being locked by the locking collar (142) of the outer cap (140) through an undercut fitting method.

7. The cosmetic powder container as set forth in claim 5, wherein the sealing bottom (152) of the sealing cap (150) has a side surface configured in the form of a vertical side surface (152*a*) so as to come into vertical close contact with a vertical side surface (134) of the sealing step (133) provided in the middle cap (130).

8. The cosmetic powder container as set forth in claim 5, wherein the sealing bottom (152) of the sealing cap (150) has a side surface configured in the form of an inclined side surface (152*b*) so as to come into inclined close contact with an upper end corner (134*a*) of a vertical side surface (134) of the sealing step (133) provided in the middle cap (130).

9. The cosmetic powder container as set forth in claim 5, wherein the sealing bottom (152) of the sealing cap (150) provided in the outer cap (140) is provided on a lower surface thereof with a powder spreading depression (154) for evenly spreading powder, which has been applied to the make-up utensil, over the make-up utensil.

10. A cosmetic powder container comprising:

a container body (110) defining therein a powder chamber (112) for containing powder (P) that is a beautifier; a middle cap (130) seated in an upper end of the container body, with a powder discharging part (132) comprising a flexible mesh (132*a*) mounted to a sealing step (134) defined in a central area of the middle cap in such a way that the powder discharging part is stepped downwards, so that a user can use the powder by pressing a make-up utensil (120), such as a powder brush, against the flexible mesh (132*a*) and by applying the powder contained in the powder chamber to the make-up utensil; and an outer cap (140) openably fastened to an upper part of the container body, with a locking collar (142) formed in a central area of a lower part of the outer cap (140) and a sealing cap (150) having a sealing bottom (152) locked to the locking collar, wherein the powder discharging part of the middle cap can be opened or closed by the sealing cap in response to an open or closing motion of the outer cap, wherein the sealing cap (150) is locked to the locking collar (142) of the outer cap by being fitted over the locking collar at an annular groove (155) formed in an upper end of the sealing bottom, with an annular sealing foot (151) protruding from a lower surface of the sealing cap at a location outside the sealing step (134) so as to come into close contact with an upper surface of the middle cap (130), thereby closing the powder discharging part (132).

11. The cosmetic powder container as set forth in claim 10, wherein the sealing cap (150) further comprises a powder spreading depression (154) provided in a lower central area of the sealing cap for allowing a user to turn the make-up utensil (120), such as a powder brush, against the powder spreading depression so as to evenly spread the cosmetic powder applied to the make-up utensil over the make-up utensil.

* * * * *